US009044797B2

(12) United States Patent
Friedrichs

(10) Patent No.: US 9,044,797 B2
(45) Date of Patent: Jun. 2, 2015

(54) DEVICE FOR PRODUCING A CIRCULARLY CYLINDRICAL BODY

(71) Applicant: Arno Friedrichs, Kulmbach (DE)

(72) Inventor: Arno Friedrichs, Kulmbach (DE)

( * ) Notice: Subject to any disclaimer, the term of this patent is extended or adjusted under 35 U.S.C. 154(b) by 0 days.

(21) Appl. No.: 14/471,318

(22) Filed: Aug. 28, 2014

(65) Prior Publication Data

US 2015/0027188 A1 Jan. 29, 2015

Related U.S. Application Data

(62) Division of application No. 12/737,444, filed as application No. PCT/EP2009/057583 on Jun. 18, 2009, now Pat. No. 8,850,861.

(30) Foreign Application Priority Data

Jul. 16, 2008 (DE) ..... 10 2008 033 413

(51) Int. Cl.

| | |
|---|---|
| ***B21B 1/16*** | (2006.01) |
| ***B21H 1/18*** | (2006.01) |
| ***B21H 3/10*** | (2006.01) |
| ***B21K 5/04*** | (2006.01) |
| ***B22F 3/18*** | (2006.01) |
| ***B22F 5/10*** | (2006.01) |
| ***B28B 11/00*** | (2006.01) |

(52) U.S. Cl.

CPC .. *B21B 1/16* (2013.01); *B21H 1/18* (2013.01); *B21H 3/10* (2013.01); *B21K 5/04* (2013.01); *B22F 3/18* (2013.01); *B22F 5/10* (2013.01); *B22F 2998/10* (2013.01); *B28B 11/006* (2013.01)

(58) Field of Classification Search

CPC ..... B21B 1/16; B21H 1/18; B21H 1/20
USPC ..... 72/67, 80, 89, 199, 214, 220, 371; 419/3, 43; 425/328, 334
See application file for complete search history.

(56) References Cited

U.S. PATENT DOCUMENTS

| | | | |
|---|---|---|---|
| 6,699,430 | B2 | 3/2004 | Friedrichs |
| 2002/0140125 | A1 | 10/2002 | Friedrichs |

FOREIGN PATENT DOCUMENTS

| | | | |
|---|---|---|---|
| EP | 0 173 675 | A1 | 3/1986 |
| EP | 0 465 946 | A1 | 1/1992 |
| EP | 1 230 046 | B1 | 8/2002 |

(Continued)

OTHER PUBLICATIONS

International Search Report for PCT/EP2009/057583 dated Sep. 21, 2009.

*Primary Examiner* — Debra Sullivan
(74) *Attorney, Agent, or Firm* — Collard & Roe, P.C.

(57) ABSTRACT

A method is for producing a circular cylindrical body (10) comprising a workable mass, having at least one helical internal cavity extending in the interior of the body. The body (10) is initially produced with a straight internal recess, for example by means of extrusion. Afterwards the body is cut to a defined length. The body (10) that has been cut to length is then subjected to a rolling process by means of a friction surface arrangement (23) while being supported over the entire length thereof on a support means (16). The rolling process takes place in multiple steps, wherein a rolling movement using a first axis of rotation (25) is performed in a first step, and a rolling movement using a second axis of rotation (26) that is different from the first axis of rotation is used in a second step. There is also an apparatus for performing the method.

8 Claims, 2 Drawing Sheets

(56) References Cited

FOREIGN PATENT DOCUMENTS

| | | | |
|---|---|---|---|
| JP | 02-138404 | A | 5/1990 |
| JP | 04-198404 | A | 7/1992 |
| JP | 04-198405 | A | 7/1992 |
| JP | 04-210407 | A | 7/1992 |
| JP | 2003-508634 | A | 3/2003 |
| WO | WO 01/17705 | A2 | 3/2001 |

PRIOR ART
Fig. 1
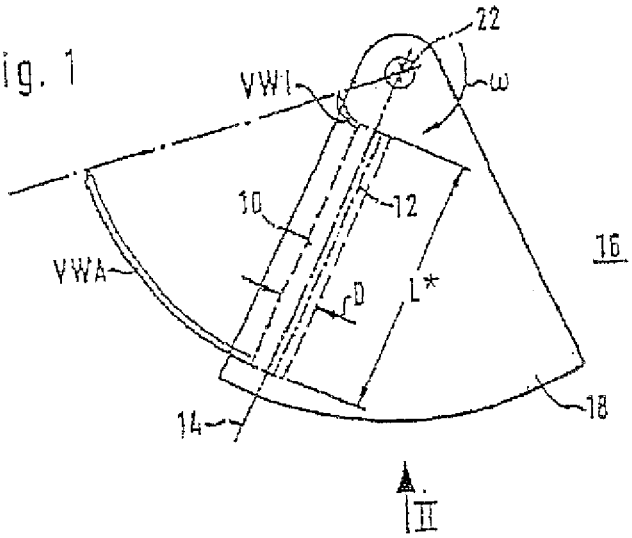
PRIOR ART
Fig. 2
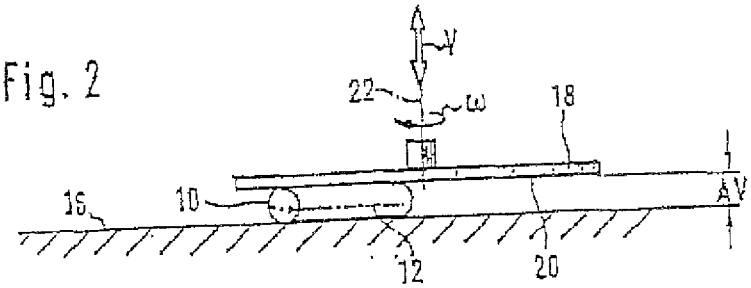
PRIOR ART
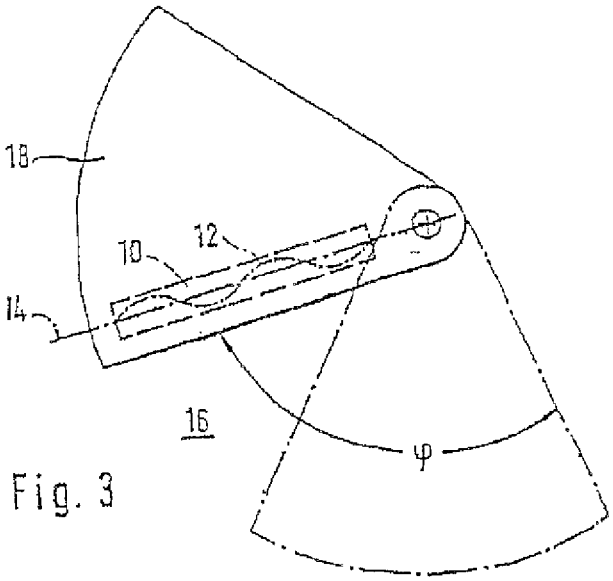
Fig. 3

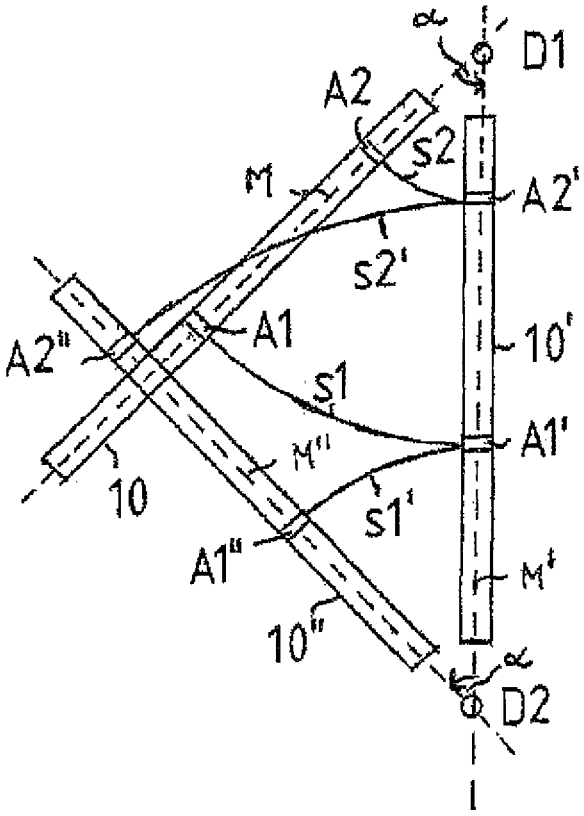
Fig. 4
Fig. 5
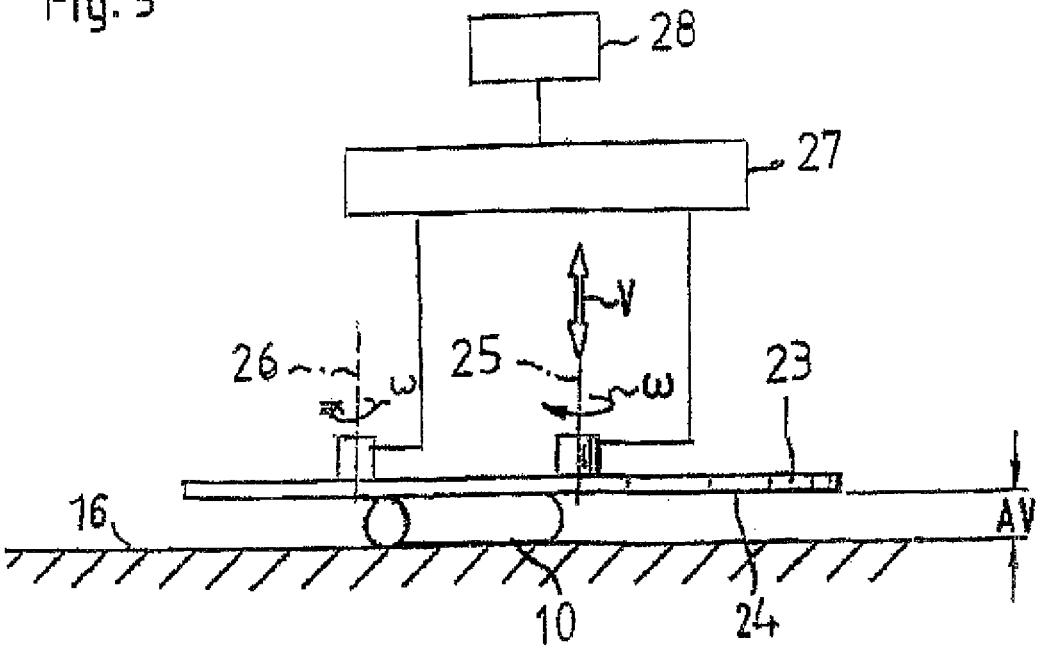

DEVICE FOR PRODUCING A CIRCULARLY CYLINDRICAL BODY

CROSS REFERENCE TO RELATED APPLICATIONS

This application is a Divisional Patent Application under 35 U.S.C. 120 and 35 U.S.C. 121 of U.S. patent application Ser. No. 12/737,444 filed on Jan. 14, 2011, which is the National Stage of PCT/EP2009/057583 filed on Jun. 18, 2009, which claims priority under 35 U.S.C. §119 of German Application No. 10 2008 033 413.8 filed on Jul. 16, 2008, the disclosure of which is incorporated by reference. The international application under OCT article 21(2) was not published in English.

BACKGROUND OF THE INVENTION

1. Field of Invention

The invention relates to a method and a device for producing a circularly cylindrical body consisting of plastics material, particularly a sintered metal blank, which has at least one helical internal recess extending in the interior of the body.

2. Prior Art

Such bodies are needed particularly in the production of drilling tools or drilling tool inserts of hard metal or ceramic materials. Through the helical course of the at least one internal recess, which serves in the finished drilling tool for the feed of coolant or lubricant to the cutting zone, the drilling tool can be furnished with helical cutting grooves, which is often of advantage for providing favourable cutting and machining characteristics and accordingly is desired.

It has already been previously attempted to produce such sintered metal or ceramic blanks by an extrusion process in that the material consisting of sintered metal powder or ceramic powder and binder is forced through an extrusion die which has a cross-section corresponding with the desired blank cross-section and at least one internally disposed core in the form of a pin, which during extrusion of the plasticised material serves for formation of the internal recess extending through the entire blank.

The material issuing from the extrusion die is usually very pressure-sensitive, i.e. the issuing blank deforms extremely easily in the case of external application of force. Since such deformations are no longer reversible and thus lead to blanks which are unusable at least in sections, it has been attempted to further develop the extrusion process so that the blank has helically extending cooling channels already at the time of issue from the extrusion die. According to one proposal (see, for example EP-A-0 465 946), this is achieved in that formed at the inner circumference of the extrusion die are helically extending guide strips which impose a twisting motion on the issuing plastic material. Flexible threads with a cross-section corresponding with the cross-section of the internal recess to be produced are fastened in the cross-section of the extrusion nozzle, wherein the threads extend up to the outlet of the die mouthpiece. Due to the flexibility of the threads these can follow the torsional movement or torsional flow of the plastic material and thus produce at least one internally disposed cooling channel in the blank.

According to a further proposal the die mouthpiece and/or a hub of propeller-like form, to which are fastened the aforementioned threads which are flexible or slack with respect to bending, is or are set into rotational movement during the extrusion process, whereby in turn an externally smooth blank with internally disposed helical channels or recesses can be produced.

In the manufacture of such tool blanks it is important for the angle of inclination of the at least one helical internal recess to be kept constant and within closely toleranced limits over the entire length of the blank. This is required because regular cutting grooves are ground into the tool blank after the sintering process. This grinding is carried out by largely automated machines so that in the case of inaccurate production of the helical internal recesses an uncontrollably high wastage rate can result. In that case it is to be taken into consideration that use is made of tools with fully hard metal cutting parts for the reason, inter alia, that utilisation is to be made of the high capability of loading the material, particularly the torsional stiffness. In order to ensure this, the internal recess must not reach too closely to the cutting groove, which in the case of inaccurate production of the helical internal recess cannot, however, be effectively excluded.

In the case of the afore-described approaches for producing the blank with internally disposed helical recesses it is accordingly necessary to monitor the extrusion tool and/or the sintering devices for the extrusion worm or—in present—for the twist-generating bodies during the extrusion process as accurately as possible and adapt to the mass throughput. This has the consequence that comparatively lengthy re-equipping and adjusting times are required at the extrusion tool, with the result that conventional methods are primarily used economically for large batches. For small batches or for the production of drilling tools with larger nominal diameters disproportionately high machine set-up costs arise, whereby the economics of the production method are called into question.

A method and a device for producing a sintered metal blank with internally disposed helical recesses are already known from EP-B1-1 230 046. According to this known method, initially a substantially circularly cylindrical body with at least one internal recess extending rectilinearly in its interior is produced, for example extruded. This body is cut to a desired length and subsequently subjected, while being supported over its entire length on a support, to a rolling movement by means of a friction surface arrangement, the speed of which changes linearly and constantly over the length of the body, whereby the body is uniformly twisted. This twisting is carried out with use of an axis of rotation which intersects the longitudinal axis of the body.

By means of the method known from BP-B1-1 230 046 it is possible to produce sintered metal blanks in which the angle of inclination of the at least one helical internal recess is constant over the entire length of the blank and is kept within closely toleranced limits. As a result it can usually be ensured that the at least one internal recess does not reach too closely to the cutting groove which still has to be formed.

In practice there are increasingly higher demands on keeping the angle of inclination of the at least one helical internal recess over the entire length of the blank constantly within closely toleranced limits.

SUMMARY OF THE INVENTION

The object of the invention accordingly consists in indicating a method and a device for producing a circularly cylindrical body consisting of a plastic mass, which method or device does justice to these higher demands.

This object is fulfilled by a method with the features of the invention. Advantageous developments are indicated in other embodiments. There is also a device for producing a circularly cylindrical body consisting of a plastic mass. There are other advantageous embodiments and developments of the invention.

The advantages of the invention consist particularly in that by means of the claimed method it is possible to produce circularly cylindrical bodies which consist of a plastic mass and the at least one helical internal recess of which has over the entire length of the body an extremely constant angle of inclination kept within very closely toleranced limits. This advantage is based on the fact that the individual length sections of the circularly cylindrical body each cover the same path during the rolling process. By contrast thereto, in the case of the method known from EP-B1-1 230 046 the individual length sections of the circularly cylindrical body cover paths of different length. In particular, the paths which length sections near the axis of rotation cover during the rolling process are comparatively small, whilst those length sections which are arranged at a distance from the axis of rotation cover comparatively large paths during the rolling process. This has the consequence that the gradient accuracy of the helical recesses in the length sections near the axis of rotation, is lower than in the length sections, which lie at a distance from the axis of rotation, of the circularly cylindrical body. These different gradient accuracies in the case of the known method do not arise with use of the method according to the invention.

BRIEF DESCRIPTION OF THE DRAWINGS

Further advantageous characteristics of the invention are evident from the explanation, by way of example, on the basis of the figures, in which:

FIG. 1 shows a plan view of a form of embodiment of a device for producing a sintered metal blank, which consists of a plastic mass, with an internally disposed recess in accordance with the prior art, FIG. 2 shows the view in correspondence with 11 in FIG. 1, FIG. 3 shows, in a view corresponding with FIG. 1, the device after twisting of the extruded blank, FIG. 4 shows a diagram for clarification, of the change of the axis of rotation during the rolling movement in a method according to the invention and FIG. 5 shows a diagram for clarification of a device for performing the method according to the invention.

DETAILED DESCRIPTION OF THE PREFERRED EMBODIMENTS

A sinter or sintered metal blank, which is cut to a predetermined length L*, i.e. cut-to-length, and which consists of, for example, a hard metal powder with a kneaded-in binder or adhesive, is denoted in FIGS. 1 to 3 by the reference numeral 10. This sinter or sintered metal blank is produced, for example, in an extrusion process and, in particular, in the manner that it has a rectilinear and continuous internal recess 12, which is illustrated in the figures by dot-dashed lines and which extends parallel to the centre axis 14 of the circularly cylindrical blank 10.

The production of the sintered metal blank is preferably carried out in an extrusion process with the assistance of an extrusion die with a suitable core. The blank 10 has a comparatively soft consistency so that handling such as, for example, transport, has to be carried out very carefully in order to prevent irreversible deformations. Accordingly, the blank is preferably guided on an air cushion directly after issue from the extrusion die and conducted to the support 16 which is shown in figures and which in FIGS. 1 and 3 coincides with the drawing plane. Due to the consistency of the extruded mass the blank is sticky on its outer side, so that good adhesion to the support surface 16 results.

In order to shape the blank 10 in such a manner that the rectilinear internal recess according to FIG. 1 or 2 is reshaped into a helical recess, the following arrangement is provided:

Arranged parallel to a support surface 16 at a vertical spacing AV is a circularly segmental disc 18 with a friction surface 20 at the base. The circularly segmental disc 18 is rotatable about an axis 22 of rotation, which is perpendicular to the surface of the support 16 or the friction surface. The vertical spacing AV between the surfaces 16 and 20 is preferably adjustable, which is indicated by the double arrow V in FIG. 2. This vertical spacing AV corresponds with the diameter D of the blank 10.

As shown in FIG. 1, the blank 10 is so placed on the support 16 that its longitudinal axis 14 intersects the axis 22 of rotation of the circularly segmental disc 18. The circularly segmental disc is subsequently lowered in controlled manner so that it touches the blank 10 along a line which is offset diametrally relative to the base-side contact line of the blank 10 with the support 16. This orientation is shown in FIGS. 1 and 2.

The circularly segmental disc 18 is now pivoted at an angular speed ω. Due to the frictional contact between the surface 20 of the circularly segmental disc 18 and the blank 10 the blank is entrained in that it rolls on the surface of the support 16 at a speed which changes linearly and constantly along the axis of the blank 10. The rolling speed at the inner end of the blank 10 is denoted by VWI and the rolling speed at the outer end of the blank 10 is denoted by VWA. If the segmental disc 18 runs through a defined pivot angle ψ a linear distribution of the rolling path along the rod-shaped blank 10 arises, with the consequence that the circularly cylindrical blank 10 is twisted during the rolling movement and, in particular, in such a manner that an angle of inclination of the twisting and thus an angle of inclination of the helical internal recess 12 directly proportional to the pivot angle ψ result.

The circularly segmental disc 18 is preferably kept in contact with the rod-shaped blank 10 by the smallest possible support force and, in particular, during the entire twisting process, i.e. during the entire pivotation about the pivotation angle ψ (see FIG. 3). Here it can be of advantage to operate with pressure sensors which act on the raising and lowering device (not illustrated in more detail) for the circularly segmental disc 18.

It is apparent from the foregoing description and FIGS. 1 to 3 that the individual length sections of the blank 10 cover rolling paths or path lengths of different size during the rolling process. Thus, the length sections of the blank 10 arranged in the vicinity of the axis 22 of rotation cover smaller rolling paths during the rolling process than length sections of the blank 10 having a greater spacing from the axis 22 of rotation. This has the consequence that the angle of inclination of the helical recess 12 (see FIG. 3) keeps to the respectively desired value less accurately and in length sections of the blank 10 arranged near the axis 22 of rotation than the angle of inclination of the helical recess in length sections of the blank arranged at a greater spacing from the axis of rotation.

This disadvantage is avoided by use of a method according to the present invention. In the case of the present invention, by contrast to the prior art described with reference to FIGS. 1 to 3 a change in the axis of rotation takes place during the rolling process. This change of the axis of rotation takes place particularly in the manner that all length sections of the blank respectively cover the same rolling path during the rolling process. The rolling process is preferably carried out in two successive steps, wherein in the first step a rolling movement about a first axis of rotation and in a second step a rolling movement about a second axis of rotation are carried out.

A method according to the invention serves, just as the method known from EP-31 230 046, for producing a circularly cylindrical body consisting of a plastic mass, particularly a sintered metal blank, which has at least one internal recess helically extending in the interior of the body.

In a method according to the invention the body is produced, for example extruded, initially with a rectilinear course of the internal recess just as in the case of the method known from EP-B1 230 046. The extruded body is cut to a desired length. Subsequently, while being supported over its entire length on a support, it is subjected to a rolling process by a friction surface arrangement so that twisting of the body takes place.

By contrast to the method known from EP-31 230 046 the axis of rotation, with the use of which the rolling process takes place, changes during the rolling process.

The rolling process is preferably carried out in two successive steps, wherein in the first step a rolling movement about a first axis of rotation and in a second step a rolling movement about a second axis of rotation are carried out, wherein the second axis of rotation differs from the first axis of rotation. The rolling process takes place in its entirety in such manner that each length section of the circularly cylindrical body covers the same path during the rolling process. The rolling direction is maintained in the successive steps.

According to a first form of embodiment of the method according to the invention the positioning of the axes of rotation is carried out in such manner that that during the first step the axis of rotation intersects the centre line of the circularly cylindrical body in the region of one axial end surface of the circularly cylindrical body and that during the second step the axis of rotation intersects the centre line of the circularly cylindrical body in the region of the other axial end surface of the circularly cylindrical body.

According to a second, preferred form of embodiment of the method according to the invention the positioning of the axes of rotation is carried out in such a manner that during the first step the axis of rotation intersects the prolonged centre line of the circularly cylindrical body at a predetermined spacing from one axial end surface of the circularly cylindrical body and during the second step the axis of rotation intersects the prolonged centre line of the circularly cylindrical body at the same predetermined spacing from the other axial end surface of the circularly cylindrical body.

A further form of embodiment of the invention consists in that the axis of rotation about which the rolling process takes place changes several times or even continuously during the rolling movement.

FIG. 4 shows a diagram for clarification of the change of the axis of rotation during the rolling process.

At the start of the rolling process the circularly cylindrical body 10 is disposed in the position in which it is illustrated by the reference numeral 10.

Starting from this position, in a first step a twisting of the body with use of the axis D1 of rotation, which runs perpendicularly to the plane of the drawing, is carried out. During this first step the body is moved through an angle which is denoted in FIG. 4 in the vicinity of the axis D1 of rotation by "α". The axis D1 of rotation intersects the center line of the circularly cylindrical body at a predetermined spacing from one axial end region of the circularly cylindrical body. During this twisting, the speed changes linearly and constantly over the length of the body. At the end of the first step the body is disposed in a position offset by the angle α. It is provided there with the reference numeral 10'.

Subsequently, in a second step a twisting of the body takes place with use of an axis D2 of rotation. This similarly runs perpendicularly to the drawing plane. The axis D2 of rotation intersects the center line M' of the circularly cylindrical body 10' at a predetermined spacing from the other axial end surface of the circularly cylindrical body. In this second step the body is moved through an angle which is denoted in FIG. 4 in the vicinity of the axis D2 of rotation similarly by "α". In the case of this twisting as well, the speed changes linearly and constantly over the length of the body. At the end of the second step the body is disposed in a position offset by the angle. It is provided there with the reference numeral 10".

The entire twisting process is adapted in such a manner that the different length sections of the circularly cylindrical body cover the respectively same path length or twisting path during the entire twisting process. This is clarified in FIG. 4 by way of the length sections A1 and A2 of the circularly cylindrical body.

The length section A1 of the circularly cylindrical body is moved in the first step through the travel path denoted in FIG. 4 by s1. After the end of the first step this length section is disposed in the body 10' and is denoted there by A1'.

In the second step the length section A1' is moved through the travel path denoted in FIG. 4 by s1'. After the end of the second step this length section is disposed in the body 10" and is denoted there by A1". The entire travel path is as follows:

$$W1=s1+s1'.$$

The length section A2 of the circularly cylindrical body is moved in the first step through the travel path denoted in FIG. 4 by s2. After the end of the first step this length section is disposed in the body 10' and denoted there by A2'. In the second step the length section A2' is moved through the travel path denoted in FIG. 4 by s2'. After the end of the second step this length section is disposed in the body 10" and is denoted there by A2". The entire travel path is as follows:

$$W2=s2+s2'.$$

In that case:

$$W1=W2.$$

Consequently, during a complete twisting process all length sections of the circularly cylindrical body run through the same total travel path. This has the consequence in advantageous manner that the gradient angle of the at least one internal recess helically extending in the interior of the body has over the entire length of the circularly cylindrical body an accuracy of inclination which is increased by comparison with the known method. This reduces the waste arising during the later grinding-in of cutting grooves or reduces the demand on working accuracy during drilling.

FIG. 5 shows a diagram for clarification of a device for performing the method according to the invention. This device has a flat support area 16. A rolling disc 23 is arranged at a vertical spacing AV therefrom. This has a friction surface 24 at the support area side. The rolling disc 23 is rotatable about an axis 25 of rotation which is perpendicular to the surface of the support area 16. This rotation is carried out at an angular speed ω. The vertical spacing AV between the support area 16 and the rolling disc 23 is adjustable, as is indicated by the double arrow V. The rolling movement is carried out in the first step with use of the axis 25 of rotation. In the succeeding second step the rolling movement is carried out with use of a second axis 26 of rotation, which is similarly perpendicular to the surface of the support area 16. This rotation is also carried out at the angular speed ω. The rolling direction in the second step corresponds with the rolling direction in the first step.

What is claimed is:

1. A device for producing a circularly cylindrical body, which consists of a deformable material and which has at least one helical internal recess extending in the interior of the body, with a support surface (16) for supporting the body (10) over the entire length thereof, a friction surface arrangement (23), which engages the body similarly over the entire length thereof, with a friction surface (24) arranged to the support and a drive unit (27) by which the friction surface arrangement is subjected to a movement producing a rolling process at the body, wherein the friction surface arrangement (23) is rotatable about a first axis of rotation and about a second axis (26) of rotation, wherein the axes of rotation extend perpendicularly to the support or to the friction surface arrangement.

2. The device according to claim 1, further comprising a control unit (28) which supplies control signals to the drive unit (27).

3. The device according to claim 2, wherein the control unit (28) generates the control signals for the drive unit (27) in such a way that in a first step of the rolling process the friction surface arrangement is rotated about the first axis (25) of rotation and in a second step of the rolling process the friction surface arrangement is rotated about the second axis (26) of rotation.

4. The device according to claim 3, wherein the control unit (28) generates the control signals for the drive unit (27) in such a way that the rotation of the friction surface arrangement in the first step and the rotation of the friction surface arrangement in the second step take place at the same angular speed (ω).

5. The device according to claim 3, wherein the control unit (28) generates the control signals for the drive unit (27) in such a way that the rotation of the friction surface arrangement in the first step and the rotation of the friction surface arrangement in the second step take place through the same size angle.

6. The device according to claim 3, wherein the control unit (28) generates the control signals for the drive unit (27) in such a way that the rolling direction is maintained in the first step and in the second step.

7. The device according to claim 1, wherein the deformable material is a sinter metal blank.

8. The device according to claim 1, wherein the deformable material is a ceramic blank.

* * * * *